US006547038B1

(12) United States Patent
Thomsen et al.

(10) Patent No.: US 6,547,038 B1
(45) Date of Patent: Apr. 15, 2003

(54) LUBRICATION SYSTEM FOR LARGE DIESEL ENGINES

(75) Inventors: Jens Thomsen, Glostrup (DK); Jørn Dragsted, Allerød (DK)

(73) Assignee: Hans Jensen Lubricators A/S, Hadsund (DK)

( * ) Notice: Subject to any disclaimer, the term of this patent is extended or adjusted under 35 U.S.C. 154(b) by 0 days.

(21) Appl. No.: 09/807,994

(22) PCT Filed: Nov. 4, 1999

(86) PCT No.: PCT/DK99/00599

§ 371 (c)(1),
(2), (4) Date: May 4, 2001

(87) PCT Pub. No.: WO00/28194

PCT Pub. Date: May 18, 2000

(30) Foreign Application Priority Data

Nov. 5, 1998 (DK) ..... 1998 01425

(51) Int. Cl.[7] ..... F01M 1/00

(52) U.S. Cl. ..... 184/6.8; 184/6.26; 184/55.1; 123/196 R

(58) Field of Search ..... 184/55.1, 15.3, 184/6.8, 6.5, 6.26; 123/196 M, 196 W, 196 R, 188.11

(56) References Cited

U.S. PATENT DOCUMENTS 1,630,547 A * 5/1927 Tartrais ..... 123/41.83
5,002,025 A * 3/1991 Crouse ..... 123/193.4
5,570,668 A * 11/1996 Hsu ..... 123/193.2

FOREIGN PATENT DOCUMENTS

| | | |
|---|---|---|
| DE | 30 35 789 | 3/1982 |
| EP | 0 368 430 | 5/1990 |
| JP | 07-034837 | 6/1995 |
| WO | WO 92/20909 | 11/1992 |

* cited by examiner

*Primary Examiner*—David Fenstermacher
(74) *Attorney, Agent, or Firm*—Nixon Peabody LLP; David S. Safran

(57) ABSTRACT

For the lubrication of the cylinders in marine diesel engines, it is normal practice to supply doses of oil through non-return valves in a ring area of the cylinder in immediate connection with the passage of a piston ring. It is aimed at providing a more-or-less uniform distribution of the oil along the circumference of the cylinder. However, a considerable variation is ascertained in the wear along this area. With the invention, use is made of a high-pressure injection through atomization nozzles, so that an outspread oil mist if formed opposite the individual nozzles, which upon being influenced by the rotating scavenging air in the cylinder is made to impinge against the wall by centrifugal force, and herewith to form a substantially continuous film of oil in a ring area immediately before the passage of the piston ring. There is hereby achieved a good utilization of the lubricating oil, i.e. a saving in oil, an a reduced and more uniform wear on the cylinder surface, to which can be added that the oil-dosing times become less critical than with conventional lubrication.

5 Claims, 1 Drawing Sheet

LUBRICATION SYSTEM FOR LARGE DIESEL ENGINES

Figure 1:
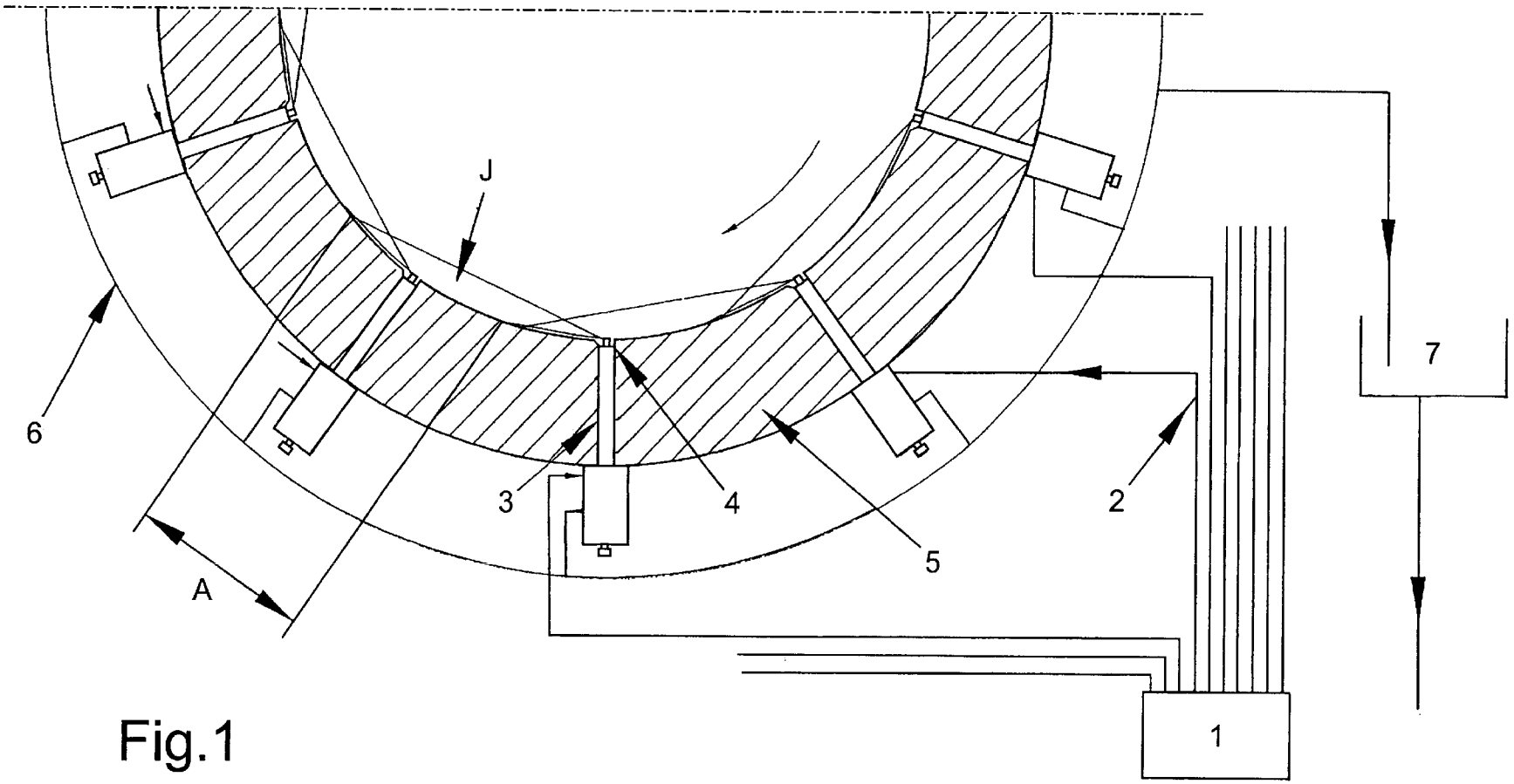

In traditional cylinder lubrication systems, mainly for large 2-stroke diesel engines, use is made of one or more central lubricators, each of which serves the lubrication points on a single or several cylinders, i.e. by the pressure-feeding of portions of oil through respective connection pipes to the various lubrication points at relevant intervals of time. See e.g. DK/EP 0678152. These relevant intervals can typically be when the piston rings are disposed opposite the relevant lubrication point during the compression stroke when the piston is moving upwards.

It has proved, however, that the compressibility of the amount of oil arising in the pipes has made it difficult to establish this correct "timing". The length of the oil pipes used in practice is often so great that the introduction of a relatively small amount of oil in the one end of the pipe merely gives rise to a compression of the oil in the pipe without the pressure being great enough to press a corresponding amount of oil out of the other end at the cylinder surface. The oil is often not dosed at the above-mentioned time, but instead at times when the pressure in the cylinder is sufficiently low, as a rule after the passage of the piston in the upwards or downwards direction. If this occurs during the downwards movement, the oil is distributed over the surface of the cylinder from the lubrication point and downwards in the cylinder lining instead of upwards towards the "hot" end of the cylinder where the lubrication is most necessary.

The development towards still greater utilisation of the engines has resulted in an increased mechanical and thermal load on cylinder linings and piston rings, which traditionally is accommodated with an increase in the dosing of cylinder oil. It has proved, however, that if the dosing is increased in excess of a certain limit, which is not defined, the speed at which the oil is introduced into the cylinder is so great that instead of remaining on the surface of the cylinder, it forms a jet inside the cylinder cavity and is hereby lost. If the dosing is effected as desired, while the piston rings are disposed opposite the piston, this is not so critical, but if the dosing takes place outside this period as described above, there is no benefit gained from a part of the oil which is dosed.

The traditional manner in which oil is distributed over the surface of the cylinder has been to establish two inclined slots per lubrication point in the surface of the cylinder, both extending out from the lubrication point and in a direction away from the top of the cylinder. When a piston rings passes such a slot, a fall in pressure occurs in the slot across the piston ring, which presses the oil away from the lubrication point. However, this and other methods have proved to be inadequate, in that in practice a considerable variation can be ascertained in the wear along the circumference of the cylinder.

Therefore, it is relevant to seek methods of improving the distribution of oil over the cylinder periphery.

With the present invention, the oil is also dosed in portions at certain periods of time, but it is distributed over the surface of the cylinder before the piston passes the lubrication points during its movement upwards.

The scavenging-air ports in uniflow-scavenged 2-stroke diesel engines are disposed in such a manner that during the scavenging, the gas mixture is set in rotating movement at the same time that the gas is displaced upwards in the cylinder, and leaves this through the exhaust valve in the top of the cylinder. The gas in the cylinder thus follows a helical line or swirl on its way-from the scavenging-air ports to the exhaust valve. Due to the centrifugal force, a sufficiently small particle of oil which exists in this swirl will be forced out towards the cylinder wall, and will finally be deposited on the wall. This effect is utilised by introducing the portions of oil into the cylinder as a "mist" of oil particles of suitable size, atomised through nozzles. By adjusting the dimensions of the nozzles, the outflow speed of the oil and the pressure before the nozzle, it is possible to control the average size of the drops of oil in the oil mist. If an oil particle or drop of oil is too small, it will "float" too long in the gas flow, and eventually be led away with the scavenging-air without impinging on the wall of the cylinder. If it is too large, due to its inertia it will continue too long in its initial path and not reach the cylinder wall, the reason being that it is overtaken by the piston and is deposited on the top of the piston.

The direction of the nozzles in relation to the flow in the cylinder can be arranged so that interaction between the individual drops of oil and the gas flow in the cylinder ensures that the drops of oil impinge on the cylinder wall over an area which corresponds by and large to the peripheral distance between two lubrication points. In this way, the oil is already distributed more or less uniformly over the cylinder surface before passage of the piston rings. Moreover, the nozzle will be able to be adjusted so that the oil impinges on the cylinder wall higher up than the nozzles. Consequently, already upon its introduction into the cylinder, the oil will not only be better distributed over the cylinder surface, but will also be "delivered" to the cylinder surface closer to the cylinder top, where the need for lubrication is greatest. Both of these conditions will result in a better utilisation of the oil, with an anticipated improvement in the cylinder lifetime/oil consumption relationship.

The feeding of the oil to the cylinder surface must be effected in measured portions, as is quite the case with the earlier-mentioned, traditional timed systems. The feeding means can be a traditional lubricator, but other feeding means with corresponding characteristics can also be envisaged.

In order to ensure that the pressure in the cylinder is not transmitted rearwards in the oil tube, a non-return valve is arranged in the normal manner in the end of the lubrication pipe, immediately in front of the inside surface of the cylinder lining. The non-return valve allows oil to pass from the oil tube to the cylinder lining, but does not allow the flow of gas in the opposite direction. These non-return valves normally have a modest opening pressure (a few bar).

The pressure which exists in the new system is necessary in the lubrication pipes between pumps and nozzles in order to ensure that the intended atomisation is considerably higher (in the order of 50–100 bar). If this were to be ensured by means of a considerable increase in the opening pressure of the traditional non-return valves, this will require stronger and more space-demanding springs, which will also result in greater "injurious space" between valve and nozzle. With traditional systems, this injurious space is already of the same magnitude as, or greater than, that amount of oil which must be dosed per portion, and therefore gives rise to a corresponding uncertainty with regard to the pressure in front of the nozzle. In order to ensure the necessary atomisation, it is necessary that the pressure required for the atomisation is available immediately upon the start of the dosing. This can be ensured, for example, by providing a valve where each of the oil tubes open out into the cylinder, and which is opened by the pressure in the oil pipe between the lubricator and the valve when this pressure has reached a certain value, such as is the case with traditional fuel oil injection systems.

Since the oil is supplied to the cylinder wall before the passage of the piston, the timing is not quite so critical as with systems where the oil must be fed precisely during the very short interval when the "pack" of piston rings is lying opposite the lubrication point.

A possible configuration of the system is shown in FIG. 1.

A number of valves (3) are arranged at suitable intervals in the cylinder lining (5), characterised in that they are set to open at a certain pressure in the oil tube (2) which leads from the oil pump (1) to the individual valves (3). At the end of the valve (3), immediately within the internal cylinder surface, there is mounted a nozzle (4) through which the oil is atomised when the pressure in the oil tube (2) reaches a certain pre-set value. The oil is fed to each oil tube (2) from an oil pump (1) consisting of a number of small pumps, one for each oil tube (2), which receive oil from the supply tank (7). The oil pumps are able to deliver a measured portion of oil at given intervals of time, and can e.g. be a traditionally timed cylinder lubricator as described in PTC application PTC/DK/00378, int. publ. no. WO96/09492, the valves (3) of which are constructed so that if an oil leakage occurs, a return pipe (6) for leakage oil is provided which leads back to the supply tank (7). J indicates a flow of oil mist from a nozzle 3, and A indicates the peripheral extent of that area of the cylinder wall towards which this jet is directed.

What is claimed is:

1. Method for cylinder wall lubrication of a diesel engines, such that in connection with the upwardly directed movement of a piston an injection of lubrication oil is effected through injection nozzles positioned in a ring area spaced below the top of an engine cylinder, said method comprising:

injecting the lubrication oil under high pressure through atomisation nozzles at a time immediately before the upward passage of said ring area by piston ring means of the piston, wherein the injection of lubrication oil from each individual nozzle is directed towards an area of the cylinder wall lying closely adjacent to the nozzle in the ring area in which the nozzles are mounted, such that before the actual passage of the piston ring means, the atomised oil forms a substantially coherent, annular film of lubrication oil on a cylinder surface.

2. Method according to claim 1, wherein the atomised oil from each nozzle is injected in that lateral direction in which rotating scavenging air appearing in the cylinder sweeps the said ring area.

3. Diesel engine with a cylinder wall lubrication system for operation by the method according to claim 1, comprising:

a plurality of oil injection nozzles arranged in a ring area in a cylinder wall spaced from the top of a cylinder of the diesel engine, an oil supply means for supplying pressurized lubrication oil to the plurality of oil injection nozzles arranged in a ring area in a cylinder wall, and control means for effecting lubrication oil injection through said nozzle during a phase of the upstroke of a piston in the cylinder, wherein the injection nozzles are atomisation nozzles and the oil supply means is adapted to supply lubrication oil at a high pressure of 50–100 bar to condition oil injection as an oil mist, and wherein said control means is operable to actuate oil mist injection during a phase of the upstroke of the piston just prior to a piston ring means of the piston passing said ring area.

4. Diesel engine according to claim 3, wherein the atomisation nozzles are configured and mounted in such a manner that each atomisation nozzle injects an oil mist towards a closely adjacent cylinder wall area in that ring area in which each nozzle is mounted.

5. Diesel engine according to claim 3, wherein each atomisation nozzle includes a pressure-controlled valve, the opening of which depends on the pressure in an associated supply pipe in which the lubrication oil pressure is sufficient for the nozzle to carry out an effective atomisation of the oil.

* * * * *